United States Patent [19]

Bowman et al.

[11] 4,221,428

[45] Sep. 9, 1980

[54] CONVERTIBLE CHAIR AND BED

[76] Inventors: John C. Bowman; Terry K. Bowman, both of 2911 E. Osborne, Phoenix, Ariz. 85016

[21] Appl. No.: 22,092

[22] Filed: Mar. 20, 1979

[51] Int. Cl.[2] ..... A47C 13/00; A47C 17/04

[52] U.S. Cl. ..... 297/110; 5/28; 297/118

[58] Field of Search ..... 297/110, 105, 108, 111, 297/118; 5/28, 29

[56] References Cited

U.S. PATENT DOCUMENTS

| | | | |
|---|---|---|---|
| 1,817,708 | 8/1931 | Pintow | 297/110 |

FOREIGN PATENT DOCUMENTS

| | | | |
|---|---|---|---|
| 846297 | 8/1952 | Fed. Rep. of Germany | 297/110 |
| 595032 | 7/1925 | France | 297/110 |
| 633815 | 10/1927 | France | 297/110 |
| 471943 | 12/1950 | Italy | 297/110 |
| 13898 | 3/1905 | Norway | 297/110 |
| 540204 | 10/1941 | United Kingdom | 297/110 |

*Primary Examiner*—James T. McCall

*Attorney, Agent, or Firm*—Gregory J. Nelson

[57] ABSTRACT

The disclosure relates to a convertible piece of furniture which may be made into a chair or a bed. The convertible chair and bed has an arm section hingedly secured to a seat section and carrying a latch bracket. A back rest is hinged to the rear of the seat section having a pedestal pivotally secured to the rear of the back rest which support the back rest in a generally horizontal position in the extended bed position. Studs project laterally from the pedestal in the chair position and are engageable in the latch bracket in the chair position. The convertible chair and bed may be incorporated in various styles of furniture and may be provided with a fixed, swivel or rocking base.

3 Claims, 15 Drawing Figures

CONVERTIBLE CHAIR AND BED

The present invention relates in general to articles of furniture and more particularly to articles of furniture of the type adapted to be conveniently converted from a rocking or conventional chair to a bed, such as a studio bed.

Various articles of furniture can be found in the prior art which are convertible from a chair to a bed. These articles usually comprise a piece of upholstered furniture having multiple sections which may be unfolded to form a bed. The shortcoming with prior art articles of furniture of this type is that they often do not have much aesthetic appeal since design considerations must give way to the functional construction which permits the chair to be made into a bed. Further, the construction of these prior art convertible chairs is such that they are often extremely heavy and unwiedly and the mechanism for converting the chair to a bed is complex. Often these chairs are unwiedly and difficult to operate, particularly for the aged or infirmed person. Accordingly, convertible chairs of the general type have not heretofore achieved great acceptance on the part of the consumer.

The present invention provides an improved convertible chair having advantages which significantly distinguish from prior art structures. Briefly, in accordance with the present invention, a convertible chair is provided having a seat supporting frame with arm supports hingedly secured to the seat frame member and disposed, in the chair position, at either side of the seat. A back rest is hingedly secured at the rear of the seat cushion and a pedestal is pivotally mounted at a position extending transversely across the rear of the back rest. In the chair position, the pedestal carries projecting pins or studs which engage a rack secured at the inner side of the arm support members. To convert the chair to a bed, the back rest is pulled forward disengaging the pins or studs from the latches and the back rest is allowed to pivot rearwardly to a horizontal or near horizontal position with the pedestal serving to support the back rest. The arm support members are pivoted forwardly to complete the bed structure.

The seat frame may be supported on any type of conventional fixed base or a rocker of conventional or swivel construction. When the back rest is folded into the bed position, the attached pedestal serves to lock the entire bed assembly in a stable position. In one embodiment of the present invention, the pedestal base may be provided with a telescopic leg so that the position of the back rest in the bed position may be adjusted from the horizontal as desired by the user. The convertible chair may be in a variety of styles such as traditional, overstuffed or even as a "Boston" rocker.

Other objects and advantages of the present invention will become more apparent from the following claims, specification and drawings in which:

Figure 7:
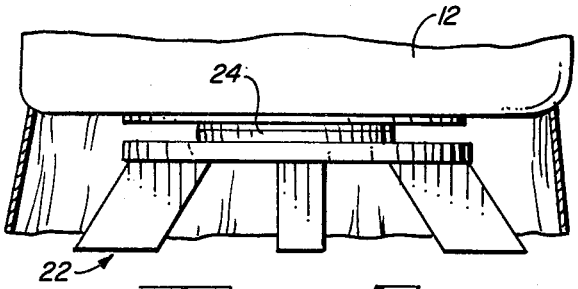
FIG. 7 is a partial side view of the swivel base which may be used with the convertible chair of the present invention.

Turning now to the drawings, a preferred embodiment of the convertible chair of the present invention is shown in FIGS. 1 to 7 and is generally designated by the numeral 10. The convertible chair 10 has three main sections, a seat section 12, back rest section 14 and arm support section 16. The seat section 12 is shown having a generally rectangular cushion 20 which may be constructed in a conventional manner on rectangular frame members 2 incorporating coil springs and padding with a suitable fabric cover. Seat section may be supported on legs or any suitable base and as shown in FIG. 7 a swivel base 22 is shown having swivel mechanism 24 secured to the underside of seat section 12 and further includes the depending legs 26. This permits the chair to be swivelled or pivoted when in the chair position. A skirt or valance 19 extends around the base of seat section 12.

Figure 1:
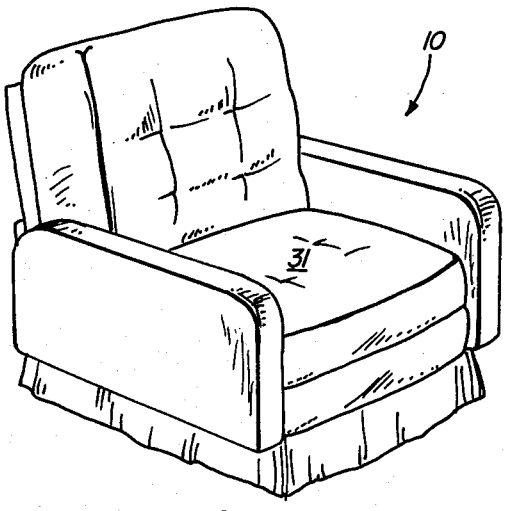
FIG. 1 is a perspective view of the convertible chair of the present invention.
Figure 3A:
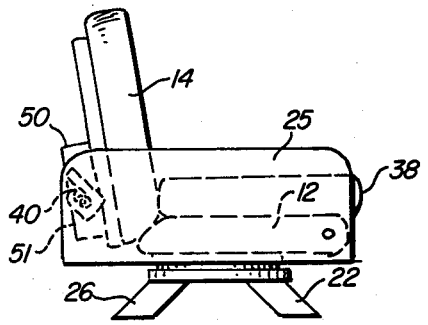
FIGS. 3A, 3B and 3C are side views showing the sequential steps involved in converting the chair into a bed.
Figure 3B:
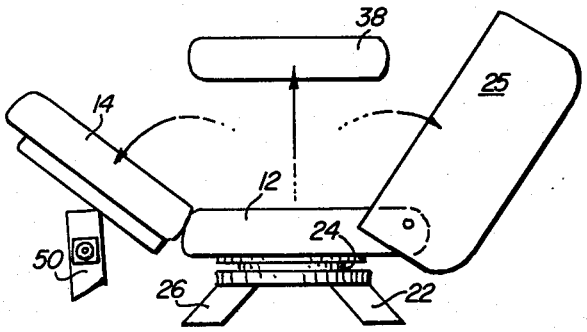
Figure 2:
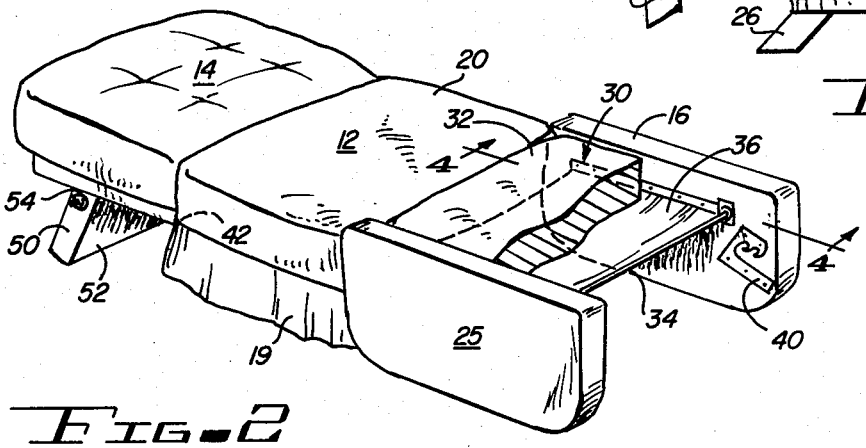
FIG. 2 is a perspective view of the convertible chair of the present invention, in an open position made into a bed.
Figure 4:
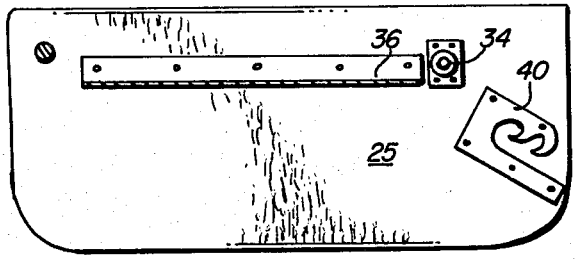
FIG. 4 is a view taken along line 4—4 of FIG. 2.

Arm section 16 is comprised of two generally rectangular panels 25 disposed at opposite transverse sides of the cushion 12. Each of the panels 25 has a frame 24 of wood or other material and may be suitably padded and covered with a fabric or, in the alternative, can be an open structure comprised of suitable frame members. The length of the panels 25 approximately corresponds to the front to back dimension of seat section 12. Similarly, the overall height of panels 25 approximately corresponds to the height of the cushion and base structure. A bolt or pivot pin 30 extends inwardly through opposite frame member 21 and engages a T-nut embedded in frame member 24 of panel 25. This permits the arm section 16 to be forwardly pivoted as shown in FIG. 3B relative to seat section 12. A rod 34 extends transversely between panels 25 and engages the rear of seat section 12 when the arm sections 16 are positioned in the chair position to help support the panels 25 as shown in FIG. 1. Support panel 36 extends transversely between the panel 25 at a horizontal location corresponding approximately to that of rod 34. Support 36 also assists supporting the seat cushion 38 when the convertible chair is in the bed position and rests on the upper surface of seat section 12 in the chair position. Support panel 36 preferably is a heavy fabric for flexibility and convenience of construction. As will be more fully explained hereafter, bracket member 40 is secured to the inside of each of the panels 25 near edge 41 as best seen in FIGS. 2 and 4.

Back rest section 14 is similarly supported on a frame member of wood or similar construction and may include coils and padding covered by a fabric as is conventional in the furniture industry. Back rest 14 is generally rectangular being pivotally connected along the rear of cushion 12 at hinges 42 by mechanical fasteners or otherwise to the frame portions of sections 12 and 14. Hinges 42 permit section 14 to be rearwardly pivoted to a near horizontal or horizontal position or to be placed in a substantially upright position as desired.

Figure 3C:
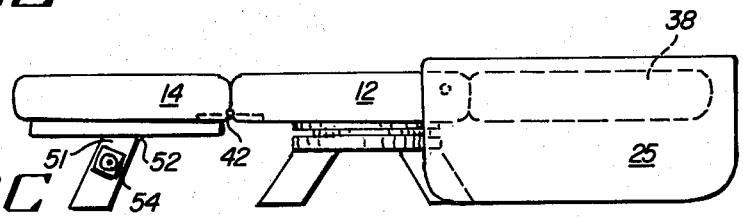

A pedestal 50 extends transversely across the back rest 14 and is pivotally connected at the approximate midpoint of the back rest at hinge 52. Pedestal 50 is of sufficient height to support the back rest 14 in a substantially horizontal position in the bed position. End portion 51 is configured so pedestal 50 is disposed at an angle with respect to back rest 14 in the extended position as shown in FIG. 3C. This increases the stability of the chair in the bed position.

Figure 5A:
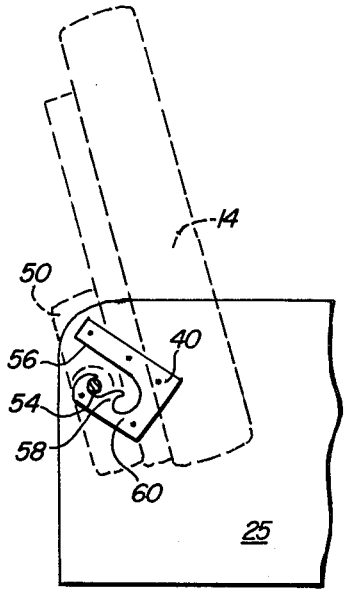
FIGS. 5A and 5B are detailed views of the latching device for securing the back rest in a substantially upright position when in a chair position.
Figure 6:
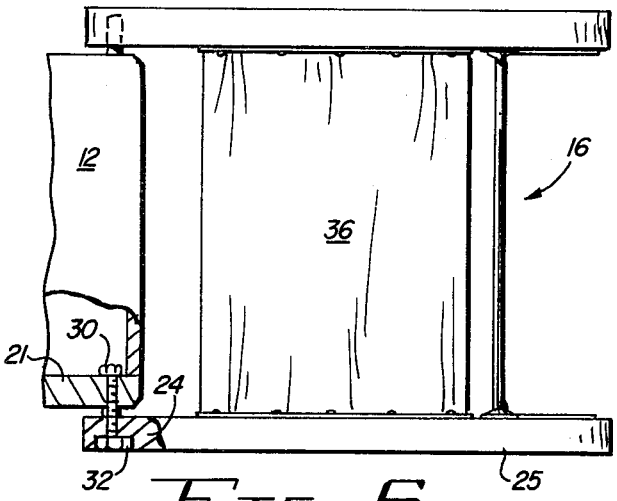
FIG. 6 is a top view of the arm support section when folded into a bed position.
Figure 5B:
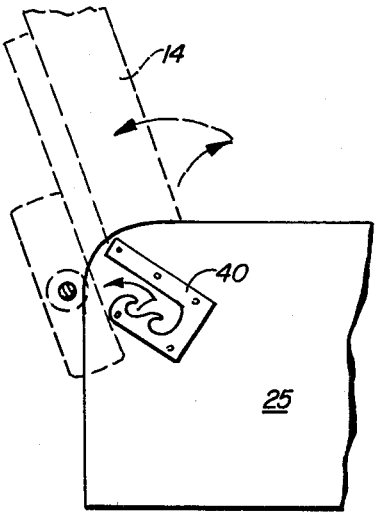

A pin or stud 54 extends horizontally from opposite sides 53 of pedestal 40 secured to the pedestal at mounting plate 55. In the chair position, the pedestal and stud 54 are engageable in bracket 40 to secure chair rest in the desired position. Referring to FIGS. 5A and 5B, bracket 40 is secured to the inside at the opposite arm support panels 25. Bracket 40, in the chair position, has an upwardly opening slot 56 defining one or more teeth 58 forming, as shown in these figures, two or more rack sections 60. Back rest section 14 may be placed in the desired position and studs 54 engaged in the selected rack 60 to position the back rest 14 at the appropriate angle.

Figure 11:
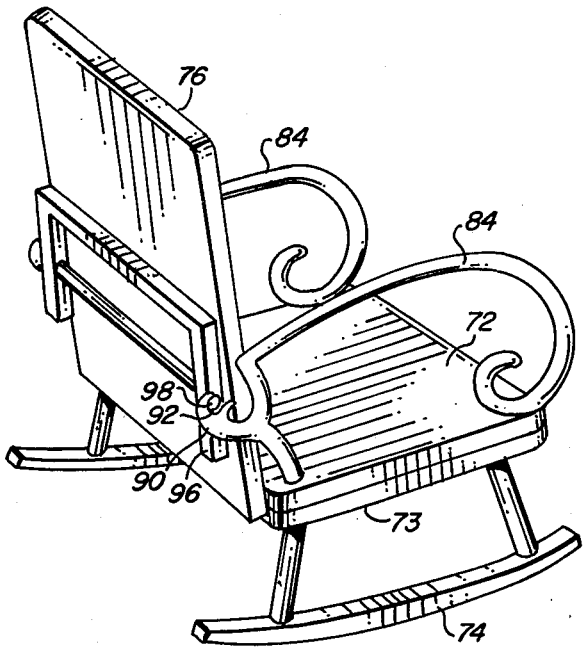
FIGS. 11 and 12 illustrate the novel concepts of the present invention incorporated with a "Boston" type rocker.
Figure 12:
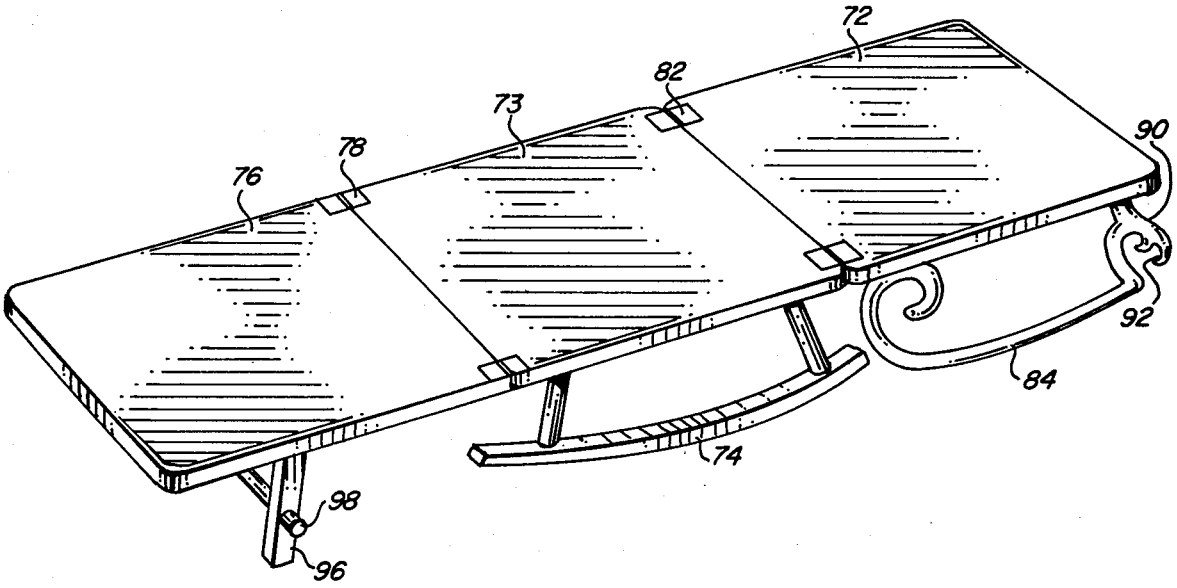

FIGS. 11 and 12 illustrate the present invention as applied to a "Boston" type rocking chair having a hardwood frame. The embodiments shown in FIGS. 11 and 12 are generally designated by the numeral 70 and includes a seat section 72 mounted on the rocking support 74. Back rest 76 is hingedly secured to seat section 72 at hinges 78. Arm support section 78 includes a panel 80 hingedly secured to the seat section 72 at hinges 82. Panel 80, in the chair position, is foldable over seat section 72 as best seen in FIG. 12. Arms 84 are disposed at either side of panel 80 and when the chair is extended in the bed position as shown in FIG. 11, serves to support panel 78 in a generally horizontal position. The rear portion of arm support 84 is configured having integrally formed bracket 90 defining rack sections 92. Pedestal 96 is in the form of two legs hinged to the rear panel 76 and serving to support back rest 76 in a generally horizontal position in the extended bed position as shown in FIG. 11. A pair of pins or studs 98 project laterally from legs 96 and are engageable in rack sections 92 in the chair position as shown in FIG. 12. In the extended bed position, an appropriate pad or mattress may be placed on the bed surface formed by sections 72, 76 and 78 for the comfort of the user. In other respects, the inventive concept is generally as has been described with reference to previous figures.

Figure 10:
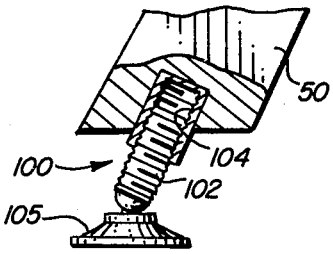
FIG. 10 is a detailed view of a portion of an alternate form of the pedestal which may be used with the convertible chair of the present invention.

FIG. 10 is a view of modified form of the invention which the pedestal 50 pivotally secured to the back rest incorporates telescopic leg member 100. Leg member 100 includes an elongate rod 102 which is telescopically recieved in a cylindrical recess 104 within the pedestal. The outer end of the rod 102 is provided with a pivotal ground engaging foot 105. A spring actuated detent mechanism 106 is selectively engageable in holes 107 in rod 102. Rod 102 and foot 105 are extended to the desired position and detent 106 engaged. This will permit the user to select the relative orientation of the cushion 14 relative to seat section 20. As the user desires the chair in a bed position to be relatively horizontal, rod 102 can be adjusted inwardly. If, on the other hand, the user wishes to elevate the back cushion to accomodate reading or watching television, rod 102 and foot 105 can be extended and detent 106 engaged in the appropriate slot 107.

Figure 8:
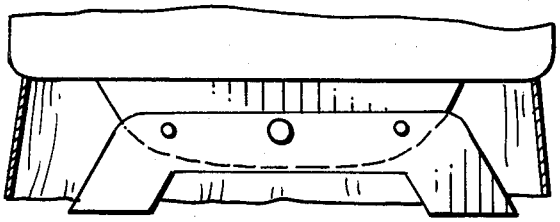
FIG. 8 is a partial side view of a platform base which may be used with the convertible chair of the present invention.
Figure 9:
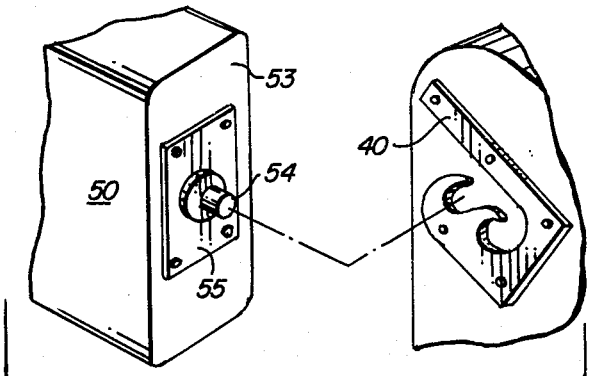
FIG. 9 is a detailed perspective view of the latch component.

The convertible chair of the present invention will be more fully understood from the following description of use. Referring to the embodiment shown in FIGS. 1 to 7, with the chair in the sitting position shown in FIG. 1, the chair may be used as any conventional chair as for example a chair of the overstuffed variety. The particular appearance and size may be varied in accordance with the preferences of the user. As shown in FIGS. 1 to 7, the chair is mounted on a swivel base 22 but could similarly be secured on a fixed base or on a rocker base as illustrated in FIG. 8. When it is desired to convert the chair into a bed, the cushion 38 is removed. The back rest 14 is then pivoted forwardly as shown in FIG. 5B. The forward pivot action disengages the opposite pins 54 from their racks 60 which then permits the back rest 14 to be pivoted rearwardly to an approximately horizontal position. Pedestal 14 can be pivoted to position as shown in FIG. 3C to support the back rest 14 in its horizontal position. The arm support section 16 can then be forwardly pivoted about pivot pins 30 to a position with the arm rest surface now engaging the ground or floor. The unit is now extended as shown in FIG. 2 and cushion 38 may be placed on transverse fabric support 36 to complete the bed unit. Note that when the sections are in this position, the action of swivel 22 is restrained due to the engagement of pedestal 50 and section 16 with the ground.

Other significant advantages are readily available with the unique chair design of the present invention. Note that the entire latch mechanism, comprising the pivot pins 54 and bracket 40 are hidden from view when the chair is in the chair position. The latch also has the advantages of engaging automatically when the back rest 14 is pulled to a near-vertical position. Once the latch is engaged, rearward pressure will not disengage the latch as this pressure will only further tend to place the pivot pin in the rack. The latch can provide for any angle back position.

The entire chair design is simple and convenient to use. The chair may be unfolded to a bed position with ease even by a child or someone infirmed. The hinges carrying the main sections of the chair together are hidden from view to further add to the aesthetic appeal of the chair. Because the mechanism is simple, the device can be made constructed of various materials and in various designs and will be light-weight. Further, the mechanism lends itself to reduced size so the overall dimensions of the chair and chair in the bed position can be closely controlled. This makes the device of the present invention particularly useful for people living in confined living quarters or small living areas such as in mobile homes.

As a rocker, the chair of the present invention provides variable pitch. The balance point of the rocker is determined by the weight of the person using the chair, the heavier the person, the more rearward the center of balance. Accordingly, the pitch of the rocker changes for the comfort of the user.

Therefore, it will be seen that the present invention provides a novel and unique convertible chair which can be manufactured in a variety of designs and which can be easily and readily converted into a bed. The unique latching device is simple and effective. We do not wish to limit ourselves to the precise details of construction and arrangement as set forth herein as it is obvious that various modifications and changes may be made by those skilled in the art without departing from the essential features of the invention as defined in the claims.

We claim:

1. An article of furniture convertible from a chair to a bed comprising:

(a) a seat section having a front, opposite sides and a rear portion;

(b) an arm section having generally vertical support members disposed generally at opposite sides of said seat section, said arm section being pivotally secured to the front of said seat section and having a first chair position with the arm section support members positioned at opposite sides of said seat section and pivotal to a second bed position with the arm and seat sections aligned in a generally horizontal position;

(c) rack means positioned at the inner side of said arm section, said rack means having teeth which are upwardly opening when said seat section is in said second position; and (d) a back rest section pivotally secured to the rear of said seat section and pedestal means freely hingedly secured to said back rest pivotal from a generally horizontal to a generally vertical position, said pedestal extending substantially across the width thereof, locking pin means projecting from opposite sides of said pedestal whereby said pin means are engageable in said rack means when the back rest section is pulled to a near vertical position and whereby said article of furniture is positionable as a chair with said arm section in said first position and said locking pin means engaged in said rack and said article of furniture positionable as a bed with said arm section in said second position and said pin means disengaged from said rack means and said pedestal engaging the surface and supporting said back rest section in a generally horizontal position.

2. The article of furniture of claim 1 wherein said seat section is supported on a rocker base and said rocker base is immobilized when said arm section and pedestal are in ground engaging position.

3. The article of furniture of claim 1 wherein said arm section includes support means extending transversely between said panels.

* * * * *